United States Patent [19]

Gryctko

[11] 4,064,469

[45] Dec. 20, 1977

[54] INTERCHANGEABLE SOLID STATE AND THERMAL-MAGNETIC TRIP UNITS

[75] Inventor: Carl E. Gryctko, Bellefontaine, Ohio

[73] Assignee: I-T-E Imperial Corporation, Spring House, Pa.

[21] Appl. No.: 675,969

[22] Filed: Apr. 12, 1976

[51] Int. Cl.[2] ..... H01H 75/00; H01H 77/00

[52] U.S. Cl. ..... 335/6; 335/21; 335/132; 361/115

[58] Field of Search ..... 335/6, 21, 18, 170, 335/172, 132; 317/58, 36 TD, 33 SC; 361/115

[56] References Cited

U.S. PATENT DOCUMENTS

| | | | |
|---|---|---|---|
| 3,636,410 | 1/1972 | Pardini | 317/36 TD |
| 3,761,778 | 9/1973 | Willard | 317/58 |
| 3,826,951 | 7/1974 | Mater et al. | 317/33 S C |
| 4,000,478 | 12/1976 | Jencks et al. | 335/170 |

*Primary Examiner*—Harold Broome

*Attorney, Agent, or Firm*—Ostrolenk Faber Gerb & Soffen

[57] ABSTRACT

A removable and replaceable solid state trip unit assembly for automatically opening a molded case multi-pole circuit breaker, is constructed so as to be interchangeable with a thermal-magnetic trip unit assembly.

5 Claims, 6 Drawing Figures

INTERCHANGEABLE SOLID STATE AND THERMAL-MAGNETIC TRIP UNITS

This invention relates to molded case multi-pole circuit breakers in general and more particularly relates to a construction for a removable and replaceable solid state automatic trip unit assembly.

In order for a circuit breaker to provide maximum protection for a given load without tripping falsely, its tripping characteristics must be tailored to withstandability of the load against damage due to overheating and electromagnetic effects. This is particularly important for a multi-pole molded case circuit breaker having a relatively high continuous current carrying capacity, say in excess of 800 amps. Traditionally, this type of circuit breaker has been provided with a thermal-magnetic trip unit for automatic operation under predetermined fault conditions. In many instances the trip unit has been constructed as a removable and replaceable assembly.

It has been known for some time that trip units utilizing solid state circuitry are more readily adjusted over a wider range of characteristics than are conventional thermal-magnetic trip units. In addition, solid state trip units achieve greater accuracy and repeatability, and with relatively simple adjustments obtain more complex time versus current characteristics. However, solid state trip units for circuit breakers of relatively high current ratings have been of excessive size. Further, factory installation was requred, and the concept of interchangeable trip units did not appear to be achievable.

The G. Gaskill co-pending application Ser. No. 671,077, filed Mar. 29, 1976, and assigned to the assignee of the instant invention, describes a removable and replaceable solid state trip unit assembly that includes current transformers for monitoring conditions in the main conductors, a permanent magnet latch and solid state processing circuitry which generates a control signal releasing the latch upon the occurrence of predetermined fault current conditions in the circuit breaker. When this latch is released spring stored energy in the latch actuates the circuit breaker trip mechanism for opening of the circuit breaker contacts.

In accordance with the instant invention, the solid state trip unit assembly includes an insulating housing wherein all of the current transformers, permanent magnet latch and solid state processing circuitry are disposed. The physical configuration of this solid state trip unit assembly is such that it is directly interchangeable with a conventional thermal-magnetic trip unit assembly.

For interchangeability with a thermal-magnetic trip assembly having individual controls accessible through apertures in the cover of the circuit breaker housing for adjusting the magnetic trip of each pole, the solid state trip assembly includes a strategically positioned control for adjusting the short time trip characteristic as a multiple of continuous current rating and also includes a strategically positioned multi-socket connector for receiving test apparatus. That is, the control and connector of the solid state trip assembly are positioned so as to be accessible through the same apertures in the circuit breaker cover provided for adjusting the instantaneous trip characteristic of the thermal-magnetic trip unit.

In addition, the solid state trip unit of the instant invention is provided with a depressible control for tripping the breaker while its cover is closed. This control is positioned so as to be accessible through an aperture in the circuit breaker cover that is provided for viewing of indicia which indicates the continuous current rating of the thermal-magnetic trip unit.

Accordingly, a primary object of the instant invention is to provide a solid state trip unit assembly that is a direct replacement for a thermal-magnetic trip unit assembly.

Another object is to provide a solid state trip assembly of this type having controls that are accessible through apertures in the circuit breaker cover that are utilized for access to other controls when the circuit breaker is provided with a thermal-magnetic trip assembly.

These objects as well as other objects of this invention shall become readily apparent after reading the following description of the accompanying drawings in which.

Figure 1:
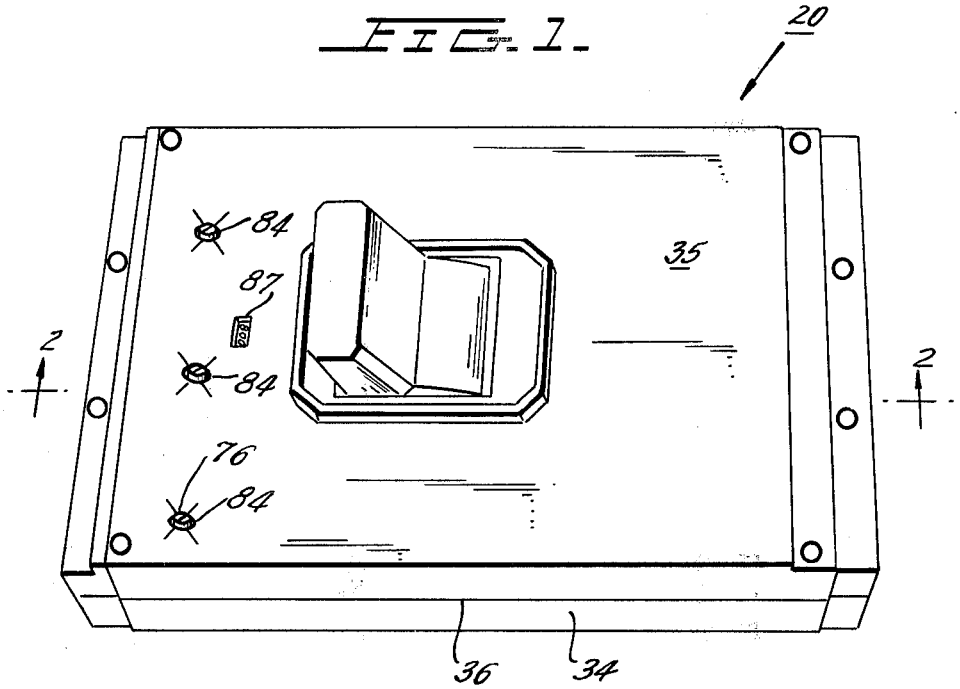
FIG. 1 is a perspective of a three pole molded case circuit breaker including a thermal-magnetic trip unit assembly.
Figure 4:
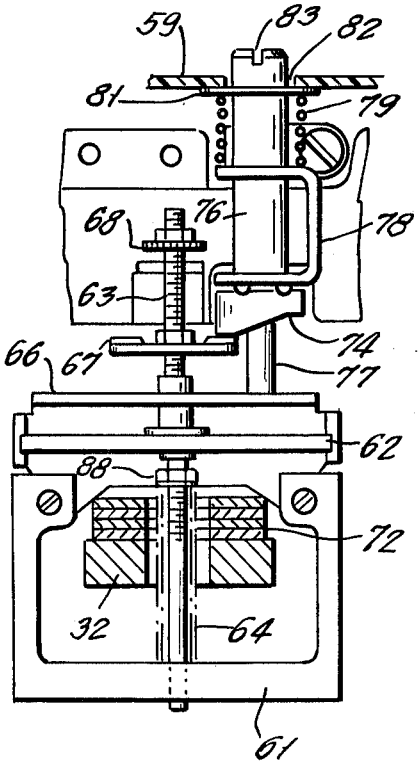
FIG. 4 is an elevation showing the magnetic trip elements of one pole of the thermal-magnetic trip unit assembly.

Now referring to the Figures and more particularly to FIGS. 1 through 4. Molded case circuit breaker 20 is a three pole unit with a common spring powered contact operating mechanism 21 all disposed within a molded insulating housing consisting of base 34 and cover 35 which is separable from base 34 at line 36. Transverse insulating bar 22 provides a mechanical tie between the movable current carrying elements of all three poles for simultaneous operation thereof in a manner well known to the art.

The current carrying path through the center pole consists of line terminal member 23, stationary arcing and main contacts 24, 25, movable arcing and main contacts 26, 27, movable contact arm 28, flexible conductor 29, strap 31, and main bus section 32 which terminates in load terminal 33. Removable screw 46, extending through a clearance aperture in the line end of bus 32, provides contact pressure between bus 32 and strap 31. The two outer poles of breaker 20 have essentially the same current carrying elements as the center pole just described.

Figure 2:
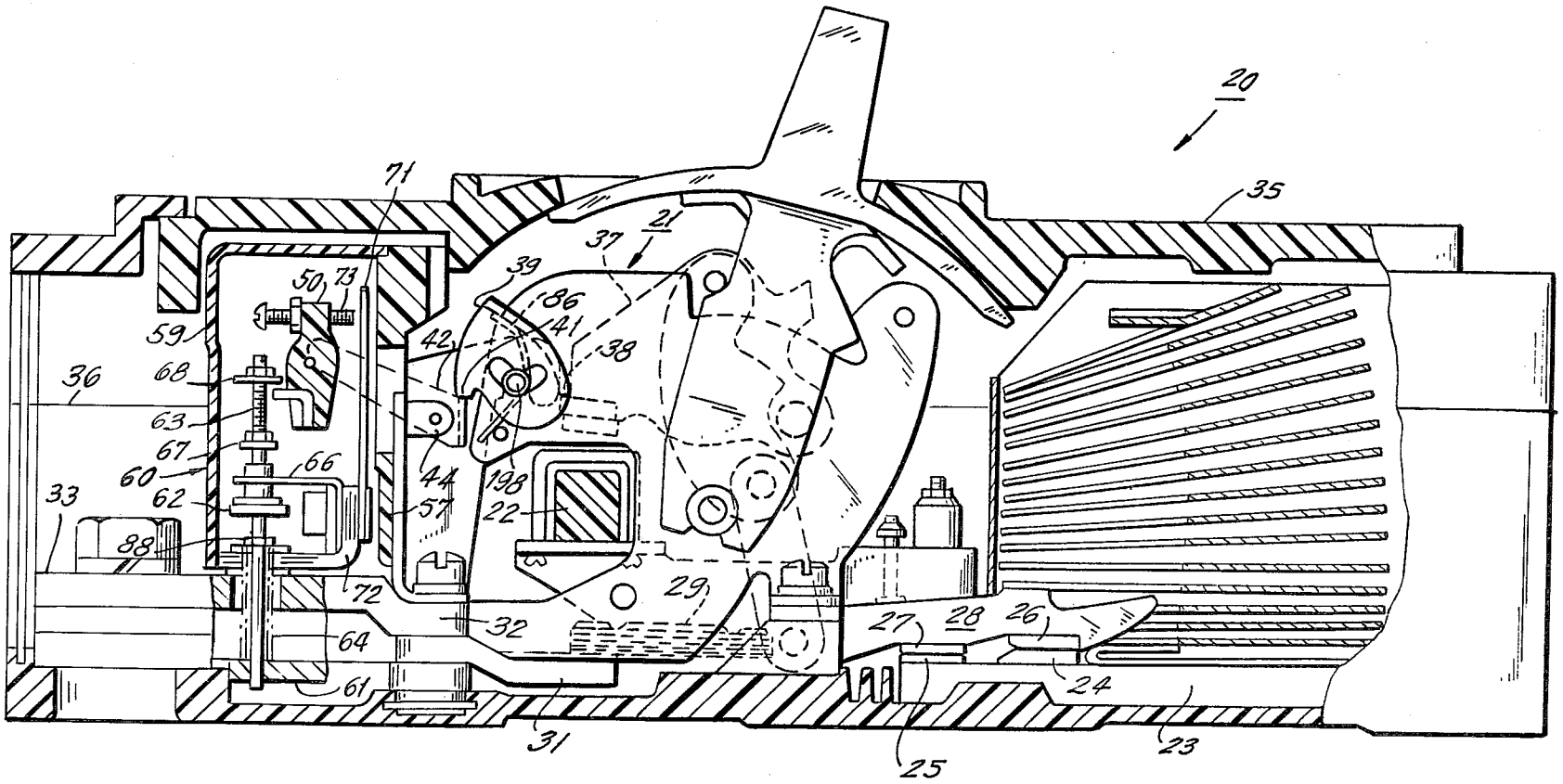
FIG. 2 is a cross-section taken through line 2—2 of FIG. 1 looking in the direction of arrows 2—2.

Contact operating mechanism 21 is a conventional trip free spring powered over center toggle unit including releasable cradle 37 which is normally held in the reset position shown in FIG. 2 by latching portion 38 of auxiliary latch 39. At point 41 auxiliary latch 39 is held by engagement with main latch 42 which is pivotally mounted to support bracket 44 on pin 43. The end of main latch remote from point 41 is normally engaged by a latching surface on transverse trip rod 50. The latter is pivotally mounted at its ends and extends parallel to wall 57.

As explained in detail in U.S. Pat. No. 3,302;140 issued Jan. 31, 1967 to A. Strobel for Circuit Breaker Instantaneous Trip Adjustment, bracket 22 and latch 50 mounted thereto constitute a subassembly which together with all three main buses 32 are element of removable and replaceable thermal-magnetic trip unit assembly 60 disposed within circuit breaker housing 34, 35 at the load end thereof. Assembly 60 also includes a common insulating frame or housing consisting of member 58, having a U-shaped cross-section, and member 59, having an L-shaped cross-section, with the latter constituting a removable cover. Wall 57 is the web portion of member 58 and is positioned on the line side of housing 58, 59. Main conductors 32 are positioned at the bottom of housing 58, 59, when viewed with respect to the FIG. 2, and extend beyond both the line and load sides of housing 58, 59.

Assembly 60 further includes U-shaped magnetic yoke 61 through which main conductor 32 extends. Armature 62 is operatively positioned to move downward towards yoke 61 when the flux field generated by current flowing in conductor 32 is of sufficient magnitude. Armature 62 is secured to the threaded upper portion of rod 63 whose lower portion extends through an aperure in conductor 32 and is guided for vertical movement by an aperture in the web portion of yoke 61. Coiled expression spring 64, interposed between yoke 61 and nut 88 threadably mounted on shaft 63, biases armature 62 upward. Engagement between nut 68, threadably mounted on shaft 63, and extension 69 on trip bar 50 when armature 62 moves downward, causes counterclockwise pivoting of trip bar 50. This releases latch 42 to unlatch mechanism 21 thereby causing the latter to separate movable contacts 26, 27 from stationary contacts 24, 25.

Bimetal strip 71 of assembly 60 extends vertically and generally parallel to the inner surface of wall 57. The lower end of bimetal 71 is fixedly secured to bracket 66 and is in heat conducting relationship with main bus 32 by means of multi-layered L-shaped conductor 72. As bimetal 71 heats, the free upper end thereof flexes to the left with respect to FIG. 2 and engages the free end of screw 73 that extends through trip bar 50, thereby rotating the latter counterclockwise to release latch 42 for tripping of circuit breaker contact operating mechanism 21.

The normal spacing betwen armature 62 and yoke 61 is set to the angular position of cam element 74 (FIG. 4) which rests against the upper surface of member 67 threadably mounted on shaft 63. Cam element 74 is secured to the lowered end of control rod 76 whose lower end is hollow and receives guide shaft 77. Rod 76 extends through aligned aperture in reverse C-shaped member 78 and is biased upward by coiled compression spring 79 which bears against the upper surface of brackets 78 and the lower surface of ring 81 secured to rod 76 near its upper end. Ring 81 engages the inner surface of cover 59 and the upper end of rod 76 extends through aperture 82 in the upper surface of cover 59. Transverse slot 83 in the upper end of rod 76 is provided to receive a screw driver (not shown) for pivoting rod 76 and cam element 74 mounted thereon.

As seen in FIG. 1, circuit breaker housing cover 35 is provided with three apertures 84 positioned in alignment with controls 76 for each of the poles of the circuit breaker 20 so that controls 76 are accessible for operation without opening circuit breaker housing 34, 35. It should now be apparent that the angular position of cam element 74 determines the fault current at which the magnetic trip will be actuated for automatic opening of circuit breaker 20.

The upper surface of cover 59 is provided with boss 86 whose upper surface bears indicia indicating the continuous current rating of trip unit 60. This indicia is viewable through aperture 87 in circuit breaker housing cover 35.

Figure 5:
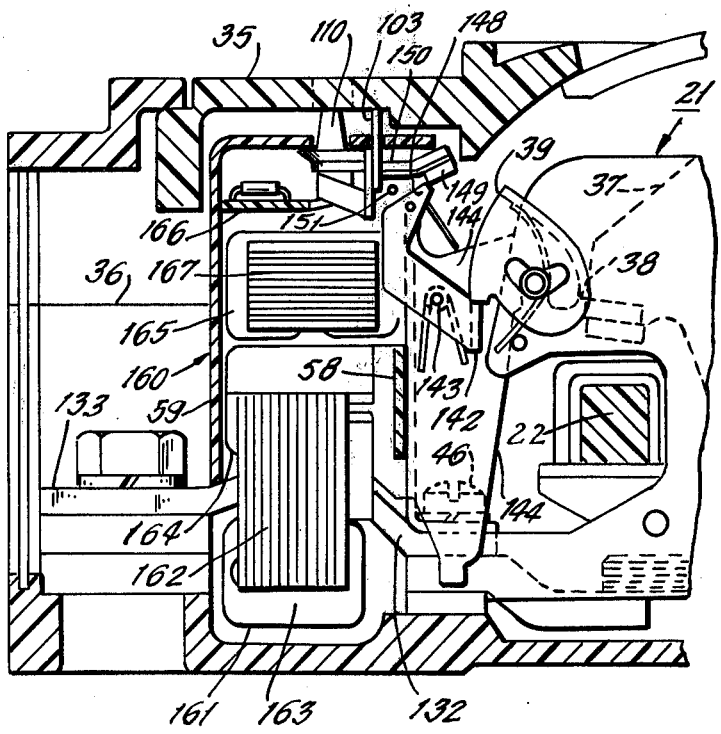
FIG. 5 is a fragmentary view, similar to the left hand section of FIG. 2, showing a removable and replaceable solid state trip assembly constructed in accordance with teachings of the instant invention.
Figure 6:
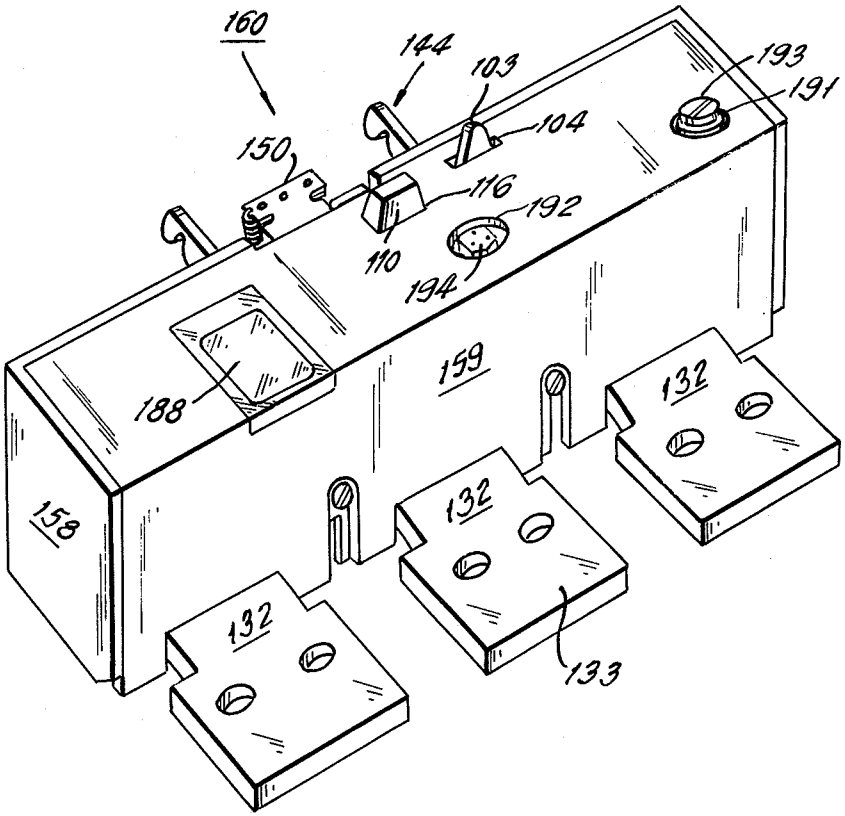
FIG. 6 is a perspective of the solid state trip assembly.
Figure 3:
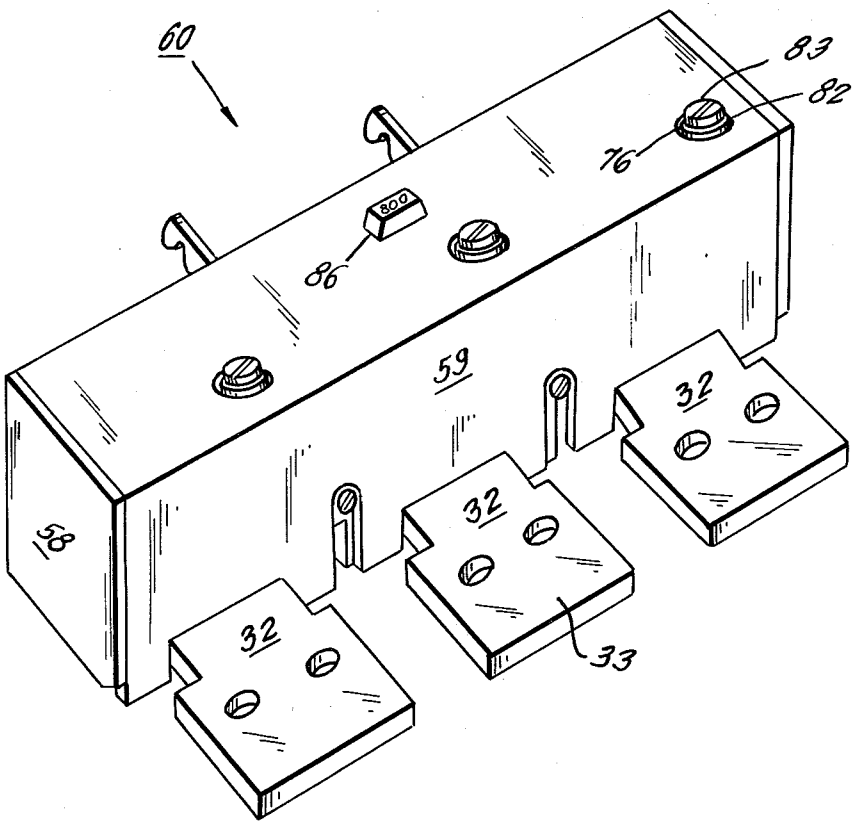
FIG. 3 is a perspective of the thermal-magnetic trip unit assembly.

Thermal-magnetic trip unit assembly 60 may be removed and replaced by solid state trip unit assembly 160 (FIGS. 5 & 6). Assembly 160 is described in detail in the aforesaid application Ser. No. 671,077. When thermal-magnetic trip assembly 60 is replace by solid state trip assembly 160, at point 41 auxiliary latch 39 is held by engagement with main latch 142 which is pivotally mounted to support bracket 144 on pin 143. The end of main latch 142 remote from point 41 is provided with nose 148 that is normally engaged by latching plate 149 on trip member 150. The latter is pivotally mounted to bracket 144 on pin 151.

Bracket 144 and the elements mounted thereto constitute a sub-assembly which, together with all three main buses 132, are elements of solid state trip unit sub-assembly 160 disposed within circuit breaker housing 34, 35 at the load end thereof. Screws 46 electrically and mechanically secure bus conductors 132 to straps 31. Sub-assembly 160 also includes a common insulating frame or housing consisting of member 158, having a U-shaped cross-section, and member 159, having an L-shaped cross-section, with the latter constituting a removable cover. Main conductors 132 are positioned at the bottom of housing 158, 159 when viewed with respect to FIGS. 5 and 6, and extend beyond both the line and load sides of housing 158, 159.

Each main conductor or bus 132 constitutes a single turn primary for an individual input transformer 161 provided for each circuit breaker pole. Each input transformer 161 also includes square laminated magnetic frame or core 162 through which primary 132 extends. The secondary of transformer 161 consists of multi-turn coils 163, 164 wound around opposite legs of core 162 and connected in series aiding relationship. The output of secondary 163, 164 is fed through the multi-turn primary of output transformer 165 whose secondary feeds the solid state control circuitry on circuit board 166. Output transformer 165 is provided with square laminated magnetic frame or core 167 having coil means mounted on opposite legs thereof with each of these coil means consisting of a portion of the primary and a portion of the secondary for output transformer 165. These primary portions are connected in series aiding relationship as are these secondary portions. In total, the secondary of transformer 165 has many more turns that the primary.

As explained in the aforesaid application Ser. No. 671,077, upon the occurrence of predetermined overload conditions in conductors 132, the solid state processing circuitry of board 166 generates a control signal that trips a permanent magnet latch (not shown) located within housing 158, 159. Tripping of this latch pivots trip member 150 counterclockwise to trip mechanism 21 and separate contacts 26, 27 from contacts 24, 25.

Depressible trip member 110 projects upward through aperture 116 in trip unit housing cover 159 and is operatively positioned to operate trip member 150. When member 110 is depressed by an instrument inserted through hole 87 in cover 35, trip member 150 is pivoted counterclockwise to trip contact operating mechanism 21.

The top of trip unit cover 159 is provided with a rectangular aperture for insertion of rating plug 188 and is also provided with slot 104 through which cover interlock ear 103 extends. Additionally, the upper surface of cover 159 is provided with circular apertures 191, 192 aligned with the lower two apertures 84 shown in FIG. 1. Pivotable adjustment control 193 extends through aperture 191 to be accessible for operation without opening circuit breaker housing 34, 35. Control 193 is used to set the short time tripping characteristic of solid state trip unit 160. Aligned with aperture 192 is multi-receptacle connector part 194 for insertion of a jack means extending from a test set that can be used to determine whether the trip characteristics of solid state trip unit assembly 160 are within limits.

When solid state trip unit assembly 160 is used in place of thermal-magnetic trip unit assembly 60 a frictionally held disc (not shown) is used to cover the uppermost aperture 84 in FIG. 1. However, rating plug 188 may be provided with a variable impedance element having an adjustment control positioned in alignment with the uppermost aperture 84 in FIG. 1 so that such control is operable without opening housing 34, 35.

It is noted that solid state trip unit assembly 160 is so constructed that all of the current monitoring transformers 161, 165 and the processing circuitry of board 166, as well as the permanent magnet latch, are disposed on the load side of the wall for housing 158, 159 that faces the circuit breaker contact mechanism.

Although there has been describe a preferred embodiment of this novel invention, many variations and modifications will now be apparent to those skilled in the art. Therefore, this invention shall not be limited by the specific disclosure herein, but only by the appended claims.

What is claimed is:

1. A removable and replaceable multi-pole solid state trip unit assembly constructed to be positioned within a housing for a molded case multi-pole circuit breaker in place of a removable thermal-magnetic trip unit assembly; said solid state trip unit assembly including an insulating frame including a wall, main circuit conductor means for each pole of said assembly extending forward and behind said wall, individual first means for monitoring current flow in each of said conductor means, solid state circuitry for processing signals transmitted thereto by said first means and generating a tripping signal upon the occurrence of predetermined fault conditions; all of said first means and said solid state circuitry being positioned behind said wall; said conductor means having its front end adapted for connection to cooperating contact means within a circuit breaker housing wherein said solid state trip unit assembly is to be installed in place of a thermal-magnetic trip unit assembly; said conductor means having its rear end adapted for connection with elements external to such circuit breaker housing.

2. A removable and replaceable multi-pole solid state trip unit assembly as set forth in claim 1 also including a short time trip adjustment control having a location accessible for operation from outside of a circuit breaker housing wherein said solid state trip unit assembly is to be installed in place of a thermal-magnetic trip unit assembly, through an aperture in a cover of such housing operatively positioned for access to a magnetic trip adjustment control of such thermal-magnetic trip unit assembly when the latter is installed in such housing.

3. A removable and replaceable multi-pole solid state trip unit assembly as set forth in claim 2 also including a trip control having a location accessible for operation from outside of a circuit breaker housing wherein said solid state trip unit assembly is to be installed in place of a thermal-magnetic trip unit assembly, through another aperture in a cover of such housing operatively positioned for viewing rating indicia on such thermal-magnetic trip unit assembly when the latter is installed in such housing.

4. A removable and replaceable multi-pole solid state trip unit assembly as set forth in claim 2 also including test connector means having a location accessible for operation from outside of a circuit breaker housing wherein said solid state trip unit assembly is to be installed in place of a thermal-magnetic trip unit assembly, through a different aperture in a cover of such housing operatively positioned for access to another magnetic trip adjustment control of such thermal-magnetic trip unit assembly when the latter is installed in such housing.

5. A removable and replaceable multi-pole solid state trip unit assembly as set forth in claim 4 also including a trip control having a location accessible for operation from outside of a circuit breaker housing wherein said solid state trip unit assembly is to be installed in place of a thermal-magnetic trip unit assembly, through another aperture in a cover of such housing operatively positioned for viewing rating indicia on such thermal-magnetic trip unit assembly when the latter is installed in such housing.

* * * * *